US009777429B2

(12) United States Patent
Mikulic

(10) Patent No.: US 9,777,429 B2
(45) Date of Patent: Oct. 3, 2017

(54) CONTINUOUS PROCESS FOR PRODUCTION OF CELLULOSE PULP FROM GRASS-LIKE PLANT FEEDSTOCK

(71) Applicant: Marinko Mikulic, Zagreb (HR)

(72) Inventor: Marinko Mikulic, Zagreb (HR)

( * ) Notice: Subject to any disclaimer, the term of this patent is extended or adjusted under 35 U.S.C. 154(b) by 0 days.

(21) Appl. No.: 15/128,285

(22) PCT Filed: Mar. 31, 2014

(86) PCT No.: PCT/HR2014/000015

§ 371 (c)(1),
(2) Date: Sep. 22, 2016

(87) PCT Pub. No.: WO2015/150841

PCT Pub. Date: Oct. 8, 2015

(65) Prior Publication Data

US 2017/0107665 A1 Apr. 20, 2017

(51) Int. Cl.
*D21C 3/02* (2006.01)
*D21C 3/06* (2006.01)
(Continued)

(52) U.S. Cl.
CPC ..... *D21C 3/06* (2013.01); *D21C 3/02* (2013.01); *D21C 3/18* (2013.01); *D21C 3/24* (2013.01);
(Continued)

(58) Field of Classification Search
CPC ... D21C 7/08; D21C 7/06; D21C 3/06; D21C 3/02
See application file for complete search history.

(56) References Cited

U.S. PATENT DOCUMENTS 3,097,987 A 7/1963 Sloman

FOREIGN PATENT DOCUMENTS

CA 2080677 4/1993
EP 2 003 241 A2 12/2008
(Continued)

OTHER PUBLICATIONS

Cappelletto et al., "Papermaking pulps from the fibrous fraction of *Miscanthus x Giganteus*," Industrial Crops and Products 11 (2000) 205-210.

(Continued)

*Primary Examiner* — Anthony Calandra
(74) *Attorney, Agent, or Firm* — RatnerPrestia

(57) ABSTRACT

A continuous process for production of cellulose pulp from grass-like plant feedstock for paper making. The process includes: preparing the grass-like plant feedstock by comminuting, dedusting, continuous digestion, disperging, diluting the cellulose pulp, screening and fractionation, concentration to remove black liquor, dilution with fresh water, and, optionally, pulp bleaching processes. The continuous digestion is performed in the vertical column at 70-100° C. for 40 minutes to 2 hours; average composition of thus formed digestion suspension is maintained within the following ranges: 0.9-1.5% w/w of NaOH; 0.15-0.4% w/w of NaCl or $Na_2SO_3$; and 15-18% w/w of grass-like plant feedstock; concentrations of ingredients being calculated on the weight of the liquid phase. Screening and fractionation are resulting with two fractions; one being further processed by milling, and another being further processed to final pulp with or without bleaching processes. The preferred grass-like feedstock for the process is *miscanthus/Miscanthus×giganteus*, Andersson/.

9 Claims, 2 Drawing Sheets

(51) Int. Cl.

| | |
|---|---|
| ***D21C 7/06*** | (2006.01) |
| ***D21C 7/08*** | (2006.01) |
| ***D21C 3/24*** | (2006.01) |
| ***D21H 11/12*** | (2006.01) |
| ***D21C 9/10*** | (2006.01) |
| ***D21C 3/18*** | (2006.01) |

(52) U.S. Cl.
CPC ..... *D21C 7/06* (2013.01); *D21C 7/08* (2013.01); *D21C 9/10* (2013.01); *D21H 11/12* (2013.01)

(56) References Cited

FOREIGN PATENT DOCUMENTS

| | | |
|---|---|---|
| GB | 686250 | 1/1953 |
| GB | 770687 | 3/1957 |
| GB | 892277 | 3/1962 |
| GB | 910001 | 11/1962 |
| GB | 1 298 745 | 12/1972 |
| GB | 2 265 918 A | 10/1993 |
| WO | WO 00/25600 | 5/2000 |

OTHER PUBLICATIONS

Wegener, "Pulping innovations in Germany," Industrial Crops and Products 1 (1993) 113-117.
International Search Report issued in PCT/HR2014/000015 dated Jan. 27, 2015 (3 pages).
Written Opinion of the International Search Authority issued in PCT/HR2014/000015 dated Jan. 27, 2015 (4 pages).

CONTINUOUS PROCESS FOR PRODUCTION OF CELLULOSE PULP FROM GRASS-LIKE PLANT FEEDSTOCK

CROSS REFERENCE TO RELATED APPLICATIONS

This application is the U.S. National Phase Application of PCT/HR2014/000015, filed Mar. 31, 2014, the contents of such application being incorporated by reference herein.

TECHNICAL FIELD

The invention is related to an improved continuous process for production of cellulose pulp from comminuted dust-free grass-like feedstock such as *miscanthus/Miscanthus×giganteus*, Andersson/.

Technical Problem

Technical problem can be defined with the question "how to produce cellulose pulp from grass-like feedstock effectively, by using the simplest possible manufacturing process and equipments, under as mild as possible digestion conditions, in order to ensure maximal preservation of natural fibers from the starting feedstock, with minimal power consumption per unit weight of the product".

Conventional cellulose pulp manufacturing uses sulphur-based chemicals with a great negative impact on environment, high water, and energy consumption.

Most important features of any successful pulp production from grass-like feedstock are to ensure:

(i) as mild as possible digestion of comminuted plant material to remove unwanted noncellulosic fraction;
(ii) minimal mechanic share force including mild mixing or even without mixing of pulp suspension;
(iii) effective screening and fractionation;
(iv) mild milling; and
(v) optionally, careful bleaching;

in order to preserve natural cellulose fibers, what is the key base for high quality paper or cellulose.

The processes that use milder chemicals during digestion often involve high energy consumption due to intensive milling of pulp in order to reach the product suitable for paper manufacturing.

The first technical problem solved with the disclosed invention is to use milder chemicals during digestion and to avoid high energy consumption accompanied with a complex mechanical processing.

The second technical problem solved with the disclosed invention is to find a solution within the frame of "green"-chemical technology, characterized by:

(a) very mild digestion conditions: 70-100° C. with 0.9-1.5 w/w NaOH and 0.15-0.4% w/w of NaCl or $Na_2SO_3$;
(b) high concentration of suspension during digestion; thus high output (productivity);
(c) high preservation of natural fibers from dust-free feedstock by using digester without any stirring device, and mild mechanical stress during disperging and screening;
(d) lower energy consumption per unit weight of the finished cellulose pulp due to the absence of complex mechanical processing; and
(e) very low usage of digestion chemicals (in comparison with the prior art), and specifically, very low usage of sulphur-based chemicals (optional $Na_2SO_3$) or even sulphur-free digestion.

According to our best knowledge, this is the first eco-friendly process for cellulose pulp manufacturing that operates at such mild digestion conditions, which is performed in such simplified process equipments, and which is subsequently improved by significantly low consumption of digestion chemicals, low water consumption, low energy consumption, and lower equipment investments. The process according to this invention does operate well when grass-like feedstock is employed.

Previous State of Art

Production of cellulose pulp for paper manufacturing from renewable, fast-growing, and more economic plant feedstock is of an increasing importance in modern industry. In this manner, classical wood-based processes are becoming to be replaced with grass-like feedstock like *miscanthus/Miscanthus×giganteus*, Andersson/, switchgrass/*Panicum virgatum*, Linne/, *sorghum/Sorghum* species, Linne/, common reed/*Phragmites australis*, Cav./, giant reed/*Arundo donax*, Linne/, straw of various cereals, etc.

Within the pulp manufacturing process, the most important phase is digestion. This means cooking of comminuted lignocellulosic material in the aqueous solution of suitable digestion chemicals. There exist several pulping processes regarding the chemicals used. The most known technologies are based on digestion with solutions of:

(i) sulphur-containing chemicals: sodium carbonate ($Na_2CO_3$) and sodium sulfite ($Na_2SO_3$), magnesium hydroxide [$Mg(OH)_2$] and magnesium sulfite ($MgSO_3$), ammonium hydroxide ($NH_4OH$) and ammonium sulfite [$(NH_4)_2SO_3$], calcium hydrogensulfite [$Ca(HSO_3)_2$], magnesium hydrogensulfite [$Mg(HSO_3)_2$], sodium hydroxide (NaOH), sodium sulfide ($Na_2S$) and sodium sulfate ($Na_2SO_4$);
(ii) non-sulphur containing chemicals: sodium carbonate ($Na_2CO_3$) and sodium hydroxide (NaOH); and
(iii) acids like nitric acid ($HNO_3$).

Such solution of digesting chemicals is also known as "white liquor", representing either fresh or regenerated solution of digestion chemicals. The white liquor helps to remove noncellulose materials, which are thus dissolved in the solution, leaving essentially pure cellulose fibers suspended in this liquid phase.

Cooked feedstock with removed noncellulosic material, i.e. a "pulp", is, at the end of digestion, suspended in used solution, which contains various chemical forms of noncellulosic plant ingredients and remains of digestion chemicals. This aqueous phase is called "black liquor". Thus, the pulp after the digestion is a suspension of essentially pure cellulose fibers in the black liquor.

Generally, from the chemical technology standpoint, older, bach type processes have been replaced by continuous ones.

Document U.S. Pat. No. 3,097,987, which is incorporated by reference, inventor A. R. Sloman, discloses very simple continuous pulping process for processing of lignocellulosic fibrous material, first by treating comminuted feedstock with overheated steam, then by pressing to remove excess of liquid, and subsequently steamed feedstock is introduced continuously on the top of cooking digester, where the solution of cooking chemicals is introduced nearby the place of feedstock inlet, also at the top of the digester. The suspension of lignocellulosic feedstock in solution of digesting chemicals are passing downward, the digestion takes place, and thus formed pulp is removed continuously at the bottom of the digester by approximately the same rate as fed.

Hereby, the disclosed digester is obviously a vertical column with smooth side walls without any screen, circulation loop, or mixing device.

However, this document do not disclose that a steam is introduced directly to the digester, with or beside the solution of digestion chemicals, but only states that the mixture is heated to the cooking temperature what, in this case, obviously means during steam-impregnation, what is, in this process, a pre-phase, before digestion itself.

Document GB 1,298,745, which is incorporated by reference, inventor R. R. Bertil, discloses a continuous process for production of cellulose pulp from plant material by: (a) separation of comminuted raw material by size; (b) impregnation of separated material with a solution of digestion chemicals; (c) removing of excess of liquid in dewaterer, to reach sufficient level of dry matter; (d) digestion of suspension of comminuted plant feedstock by moving through vertical digester downward by gravity; and (e) work-up of cooked pulp in dewaterer, to remove excess of water; see reference 2. In addition, the digester from this document does not contain any screen, mixing element, or so. The advantage of smooth interior digester's walls is used in the present invention.

Document CA 2,080,677, which is incorporated by reference, inventor K. Henricson, discloses a continuous process for production of cellulose pulp from comminuted (1-5 mm) cellulose-containing feedstock which includes: (a) separate pre-treatment of comminuted feedstock with steam in a steaming vessel; (b) impregnation of steamed feedstock with a solution of digesting chemicals ($Na_2SO_3$ and $Na_2S$) in an impregnation vessel; (c) digestion of pulp at 150-180° C. under high pressure in a digester, wherein, particles of feedstock do freely move downward from upper zone through a liquid phase, by gravity, to the bottom zone of the digester vessel, from which the cooked pulp is removed to (d) pressure diffuser, wherein the used solution (black liquor) is removed from the cooked pulp. In addition, the used digester in this technology also does not contain any screen, circulation loop, mixing device, or any other device; the digester is literally characterized by a smooth interior walls. The advantage of smooth interior digester's walls is used in the present invention.

Document GB 910,001, which is incorporated by reference, applicant Arne Asplund; teaches about Improvements in or relating to the cooking of lignocelluloses fibrous material. It discloses a combined use of vertical digester which is connected with vertical conveyor for removing cooked pulp from the latter, what is a known technologic concept in the art. The cited document reports, inter alia, of an improved technology of cooking pulp, which has connected vertical digester with vertical conveyor situated beside, and forming a connected vessel system of the U-shape in order to compensate the hydraulic pressure within the cooking vessel. The advantage of such hydraulic compensation is also used in the present invention.

Document GB 892,277, which is incorporated by reference, applicant Bauer Bros Co., teaches about a continuous digester. From the process point of view it represents the closest prior art. The cited art discloses the digestion of comminuted, herein, wood-based feedstock that is continuously fed to the top of a vertical digester, without any separate previous pre-treatment, together with steam and solution of digestion chemicals (not specified). In the upper zone of the vertical digester, the material is being heated and impregnated with digestion chemicals. In middle zone of the digester, treated wood chips are digested, and afterwards, cooked pulp is removed from the bottom part of the digester, and transported to the drainer device in order to remove excess of aqueous liquid phase (black liquor), which is regenerated back to the process. The previous teaching of GB 892,277 specifies the weight ratio of the comminuted wood chips against the liquid phase (white liquor as follows):

liquid phase(white liquor):wood chips=40-50:1 to 200:1.

The process from the present invention is, in the way of performing digestion, very similar to this one, but, substantial difference is in working concentration of the feedstock in the suspension that is subjected to digestion.

The GB 892,277 is obviously dealing with relatively very diluted suspension of comminuted wood particles in a solution of digesting chemicals (composition not specified), presumably because of freight of clogging equipments.

In contrast, the process from the present invention operates at high concentration (15-18% w/w or 5.5-6.6:1 w/w) providing high output, less water usage, and energy consumption. Also the process from the present invention is strictly based on sodium hydroxide-based digestion at very mild conditions, 0.9-1.5 w/w NaOH and 0.15-0.4% w/w of NaCl or $Na_2SO_3$, what makes it environmentally friendly.

The use of grass-like feedstock is generally well-known as alternative to wood chips for the manufacturing of cellulose pulp intended for paper production. For instance, *miscanthus/Miscanthus×giganteus*, Andersson/is one of most suitable grass-like feedstocks for such use; see references:

G. Wegener: Pulping innovations in Germany, *Ind. Crops Prod.* 1 (1992) 113-117, which is incorporated by reference; and C. Cappelletto, F. Mongardini, B. Barber', M. Sannibale, M. Brizzi, V. Pignatelli: Papermaking pulps from the fibrous fraction of *Miscanthus×Giganteus, In Crops Prod.* 11 (2000) 205-210, which is incorporated by reference.

Regarding the type of digestion, as one of the most important technological aspect of the pulp manufacturing, processes which are based on diminished use of sulphur-based chemicals are of significant advantages. The most prominent reason is ecology. The use of sulphur-free processes are of top importance in preserving environment, also avoiding corrosion problems at production equipments, as well as toxicology issues.

One of the most environmentally-friendly sulphur-free process uses sodium hydroxide-based technology. The use of sodium hydroxide (NaOH) as sole digesting chemical is known in the art. The prior art document EP 2003241 A, which is incorporated by reference, inventors N. Shin, B. Stromberg, W. J. Cann, V. Kirov, teaches about two vessel reactor system and method for hydrolysis and digestion of wood chips with chemical enhanced wash method, and about the NaOH as sole digesting chemical.

Cited sodium hydroxide (NaOH) is also used specifically in processes which are based on grass-like feedstock such as rice straw, esparto, reed, jute, and others, wherein digestion is performed with 5% aqueous solution of NaOH at 90° C. for several hours. This teaching is disclosed in GB 770,687, which is incorporated by reference, applicant Aschaffenburger Zellstoffwerke.

The technology for production of cellulose pulp from grass-like feedstock according to this invention represents a novel and inventive technology, as is disclosed in the detailed description of the invention.

SUMMARY OF INVENTION

The present invention discloses a continuous process for production of cellulose pulp from grass-like plant feedstock. This process comprising the steps of:

(i) preparing the grass-like plant feedstock by comminuting to produce a feedstock with longitudinal size distributed from 1.5-30 cm and diameter of 0.5-15 mm, and with removed fine dusty particles by dedusting of said feedstock with fan; and (ii) continuous digestion of a grass-like dust-free plant feedstock prepared in step (i) in a digester formed as a vertical column internally having only smooth side walls; where grass-like plant feedstock is continuously fed directly on the top of the said digester via conveyor.

In parallel with said dust-free feedstock top-feeding, the chemicals for digestion selected from the group consisting of NaOH and NaCl or $Na_2SO_3$, fresh water, regenerated water, and steam are introduced continuously on the top of said digester.

The digestion temperature is maintained from 70-100° C. and average composition of thus formed suspension during said continuous digestion are within the following ranges:

(a) 0.9-1.5% w/w of NaOH;

(b) 0.15-0.4% w/w of NaCl or $Na_2SO_3$; and (c) 15-18% w/w of grass-like plant feedstock;

where concentrations of ingredients being calculated on the weight of the liquid phase.

The dissolution of noncellulosic substances from the grass-like plant feedstock is performed during the mass transfer from the top to the bottom of the said digester performed only by the gravity that lasts 40 minutes to 2 hours. The cooked pulp is concentrated at the bottom of the digester, and continuously, by equal rate as being feedstock fed into the digester, discharged from the bottom of the said digester by the conveyor having the hydraulic pressure compensation.

A continuous process further comprising the steps of:

(iii) disperging, where the suspension of cooked pulp discharged from the step (ii) is processed through a disperger;

(iv) diluting, where pulp being disperged in step (iii) is diluted with water in the dilution vessel from a starting concentration 15-18% w/w to a concentration of 3-6% w/w of pulp; and (v) screening and fractionation, where diluted suspension from the step (iv) is processed through a screening and fractionation device equipped with 0.1-0.5 mm sieve.

The step (v) results with two fractions; the first fraction that does not passed through the 0.1-0.5 mm screen, in amount of maximally 50% w/w; and the second fraction that does passed through the 0.1-0.5 mm screen, in amount of minimally 50% w/w, which is considered as a good material for further processing that is transferred into the auxiliary vessel.

The first fraction obtained in step (v) is further processed by milling in 1-3 mills, and then:

(a) returned back to the auxiliary vessel in step (iv) for the reprocessing via steps (iv) and (v); or (b) transferred into the auxiliary vessel.

A continuous process for production continues further from the material collected in the auxiliary vessel via steps of:

(vi) concentration in dewaterer to remove the black liquor (regenerated water phase), dilution in auxiliary vessel with fresh water, and preparation of cellulose pulp in connected vessels; and (vii) optionally pulp bleaching step in the bleaching vessel, which is regulated via valve (52), yielding cellulose pulp suitable for paper manufacturing or production of cellulose sheets; where the used water regenerated in the dewaterer is returned through manifold back to the digester in step (ii) and into the dilution vessel in step (iv).

Step (vi) or (vii) finally yields cellulose pulp suitable for paper manufacturing or production of pure cellulose sheets.

The chemicals for digestion in step (ii) are introduced as a mixture of chemicals or each chemical separately in the form of crystalline solids or pellets; or as a mixture of chemicals or each chemical separately in the form of concentrated aqueous solutions of 30-50% w/w NaOH; and 20-30% w/w of NaCl or $Na_2SO_3$. The optimal digestion temperature is 94-98° C.

The grass-like feedstock includes stems of plant species selected from the group of: wheat/*Triticum vulgare*, Linne/; rice/*Oryza sativa*, Linne/; barley/*Horedum vulgare*, Linne/; oat/*Avena sativa*, Linne/; flax/*Linum usitatissimum*, Linne/; maize/*Zea mays*, Linne/; millets: proso millet/*Panicum miliaceum*, Linne/, pearl millet/*Pennisetum glaucum*, Linne/, browntop millet/*Panicum ramosum*, Linne/, and barnyard/*Echinochloa frumentaceae*, Linne/; triticale/×*Triticosecale*, Wittm. ex *A. Camus*/; buckwheat/*Fagopyrum esculentum*, Moench/; *miscanthus/Miscanthus×giganteus*, Andersson/; switchgrass/*Panicum virgatum*, Linne/; *sorghum/Sorghum* species, Linne/; common reed/*Phragmites australis*, Cav./, giant reed/*Arundo donax*, Linne/, burma reed/*Neyraudia reynaudiana*, Kunth./, reed-mace/*Typha* spp., Linne/, paper reed/*Cyperus papyrus*, Linne/, bur-reed/*Sparganium* spp., Linne/, thatching reed/*Thamnochortus insignis*, Linne/; esparto grass/*Stipa tenacissima*, Linne and *Lygeum spartum*, Linne/; jute/*Corchorus olitorius*, Linne/, bamboo/*Bambusoideae* spp., Linne/, *bagasse*, or mixtures thereof. The optimum grass-like feedstock is *miscanthus/Miscanthus×giganteus*, Andersson/.

DETAILED DESCRIPTION OF INVENTION

The invention is related to an improved continuous process for production of cellulose pulp from dust-free comminuted grass-like feedstock such as *miscanthus/Miscanthus×giganteus*, Andersson/.

Figure 1:
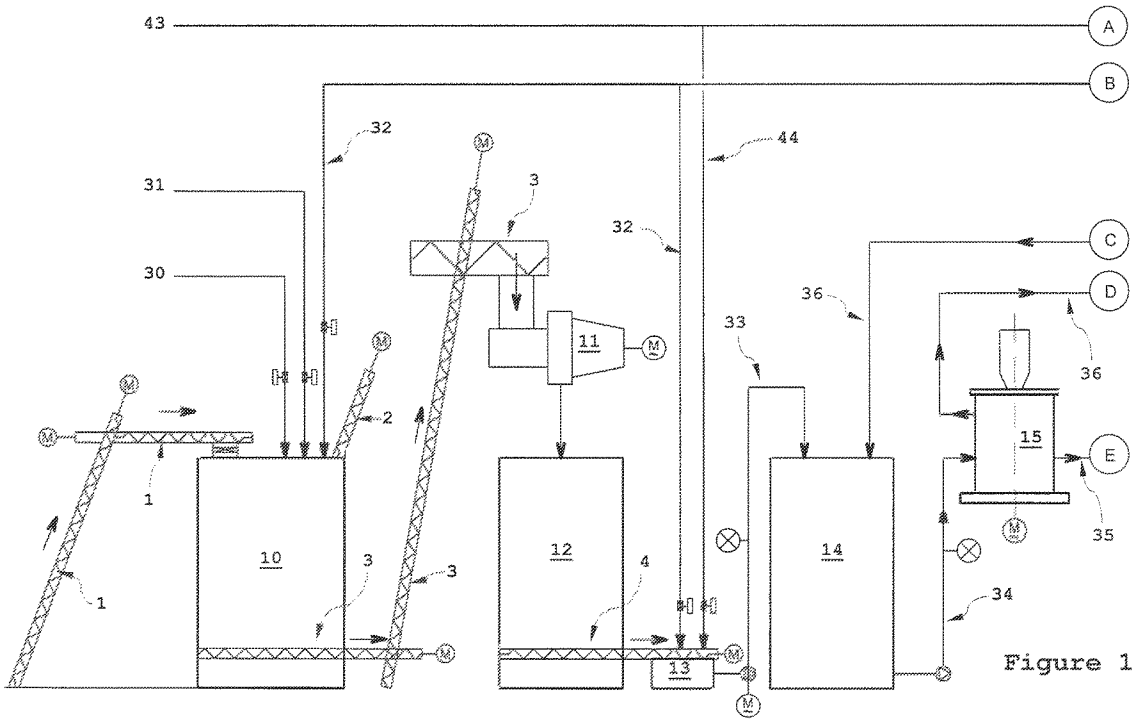
FIG. 1 shows a process for production of cellulose pulp from comminuted dust-free grass-like feedstock according to the invention; the following manufacturing phases: (ii) digestion, (iii) disperging, (iv) dilution, and (v) screening and fractionation.
Figure 2:
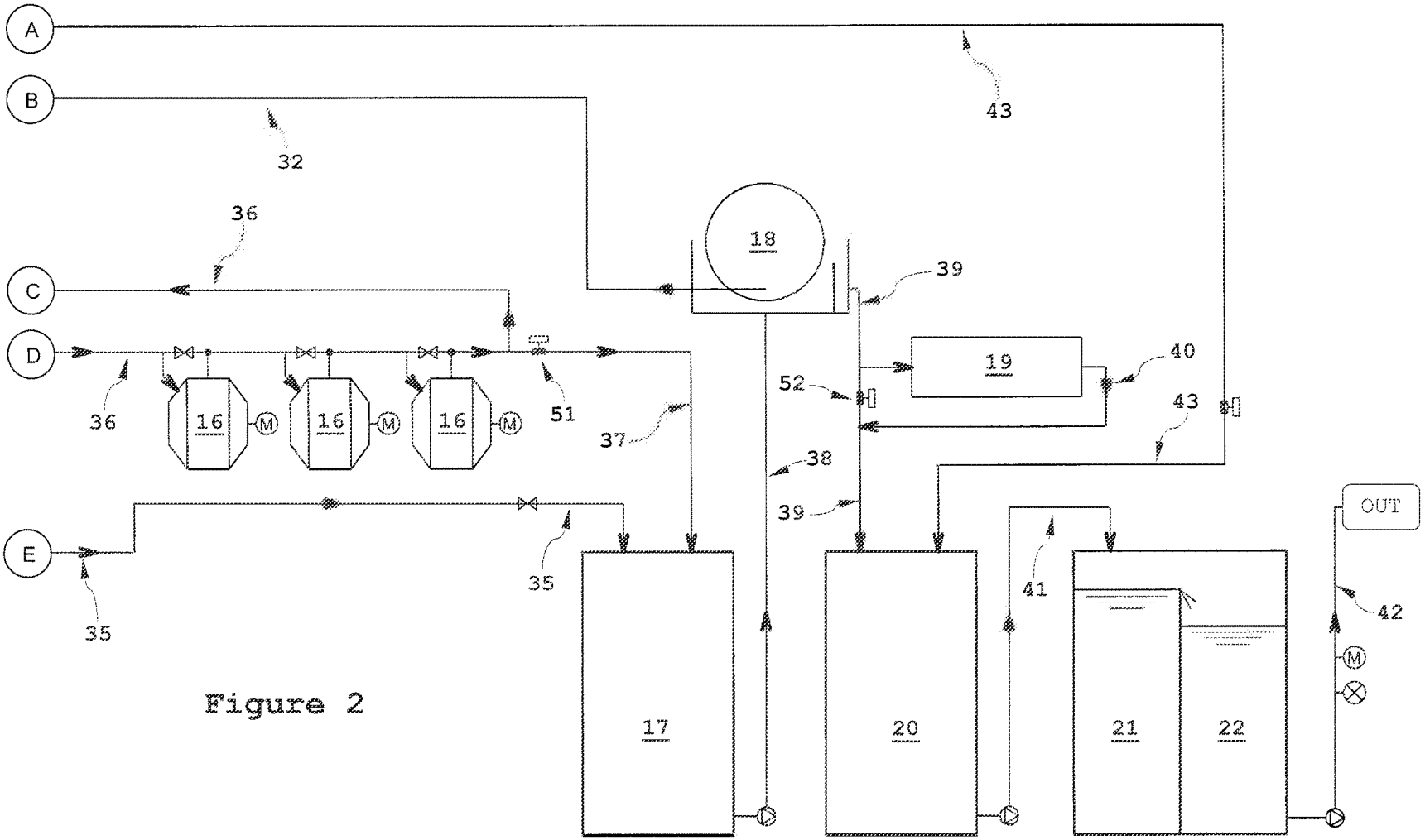
FIG. 2 shows further processing of cooked pulp according to the invention; the phases: (v) milling from the phase of screening and fractionation, (vi) concentration, dilution, and preparation of pulp for further production, and (vii) pulp bleaching (optional).

The process is performed in a continuous manner through several manufacturing phases, i-vii, as shown in FIG. 1 (phases i-v), followed by FIG. 2 (phases v-vii):

(i) Preparation of the Grass-Like Plant Feedstock

The feedstock is prepared by comminuting, to produce a material with longitudinal size distributed from 1.5-30 cm and diameter of 0.5-15 mm. Comminuting of starting grass-like material is carried out by conventional comminuting machines or supplied directly from the fields, if the crops were collected by suitable combine harvester, equipped with adequate chopping device yielding the plant material of above-stated particles dimensions.

Primarily, the comminution should be performed in a mild manner yielding fibrous material predominantly comminuted along the fibers, in order to preserve them.

This is the reason why comminution is not shown in FIG. 1, because it represents either conventional pre-treatment or may be even carried out during harvesting in the field.

Then, the comminuted material is subjected to dedusting by removal of fine, dusty, non-fibrous plant material, which would otherwise reduce the quality of resulting cellulose pulp. This is done by suitable fan which produces a strong air circulation that enable blowing away of fine light particles.

The latter fine dust does not enter into the process at all, thus saving significant amounts of chemicals that would be otherwise spent through reaction of this material with NaOH. Additionally, the effluents are not contaminated with such level of organic matter, what would significantly negatively affect the environment.

This non-fibrous fine material mainly comes from central part of plant stalks. In the case of *miscanthus*, the percentage of this fraction is roughly 8-9% w/w.

Thus collected fine non-fibrous dust can be used in the process as a fuel in energy production or, alternatively, as raw material in manufacturing of xylan.

(ii) Continuous Digestion of Grass-Like Plant Feedstock

The feedstock prepared in step (i) is further processed in a digester (10), which is a vertical column internally having only smooth side walls, without any screen, loops, or stirring device, where grass-like plant feedstock is continuously fed directly on the top of the said digester via conveyor (1).

In parallel with said dust-free feedstock top-feeding, the following materials are also introduced continuously on the top of said digester:

(a) chemicals for digestion are fed through conveyer (2);
(b) fresh water is fed through manifold (30);
(c) steam is introduced through manifold (31); as well as
(d) regenerated water which is fed through manifold (32).

From all these materials a suspension of dust-free comminuted plant material in a liquid phase consisting of aqueous solution of digesting chemicals is generated.

The digestion is preformed at temperature of 70-100° C., wherein average composition of thus formed suspension during said continuous digestion has to be maintained within the following ranges:

(a) 0.9-1.5% w/w of NaOH;
(b) 0.15-0.4% w/w of NaCl or $Na_2SO_3$; and
(c) 15-18% w/w of grass-like plant feedstock;

where concentrations of ingredients are being calculated on the weight of the liquid phase.

From this specification of the digestion suspension one can state that the digestion according to this invention is performed:

- under very mild conditions; the concentration (w/w) of the key chemicals, are very low, 0.9-1.5 w/w NaOH and 0.15-0.4% w/w of NaCl or $Na_2SO_3$, what is drastically lower than is usually employed in the prior art, see for instance references EP 2003241 and GB 770,687; this makes the process from the present invention environmentally friendly; and, in the same time,
- the working concentration of grass-like plant feedstock is relatively high; of 15-18% w/w of comminuted grass-like feedstock to solution of digestion chemicals, or 5.5-6.6:1 w/w, what is far more higher than is in the known prior art, see GB 892,277; this results in high output, less water usage, and energy consumption.

The digestion chemicals are selected from the group consisting of: sodium hydroxide (NaOH) and sodium chloride (NaCl) or sodium sulfite ($Na_2SO_3$). In this case, digestion chemicals are continuously fed via conveyor (2) separately, or as previously prepared solid mixture of commercially available crystals or pellets.

Alternatively, the digestion chemicals can be added as previously prepared concentrated aqueous solutions: as 30-50%) w/w NaOH, and 20-30% w/w of NaCl or $Na_2SO_3$. In later option, instead of conveyor (2), suitable manifold for addition of digesting chemicals is employed on the top of digester (10).

Within the operationally acceptable digestion temperature range of 70-100° C., the optimal range is 94-98° C.

The digestion is the most important part of overall process of the invention. Dissolution of noncellulosic substances from the dust-free grass-like plant feedstock takes place during mass transfer from the top of digester (10) to its bottom; this transfer eventually occurs only by the gravity that lasts from 40 minutes to 2 hours which, in the same time, represents the average duration of the digestion in this invention. During this time, the dissolution of noncellulosic substances is facilitated by the digestion chemicals.

At the top zone of the digester (10) the suspension is consisting of fresh comminuted grass-like plant material in a liquid phase of solution of digesting chemicals, which is commonly called the white liquor. As the plant material is transferred by the gravity through the suspension from the top to the bottom of the digester, what is accompanied with progression of the digestion process, the final product that is concentrated (precipitated) at the bottom of the said digester is consisting of cooked cellulose pulp which is suspended in the used chemicals, usually termed black liquor.

The cooked pulp which is concentrated at the bottom of the digester (10) is continuously, by approximately equal rate as being feedstock fed into digester, discharged from the bottom of said digester (10) by the conveyor (3), which is positioned next to the digester (10) vertically, and forms, together with the vertical digester (10), a U-type vessel, thus forming the hydraulic pressure compensation. This type hydraulic pressure compensation is know in the art and enables continuous extraction of the cooked pulp.

Thanks to this technical design, the level of the digesting suspension in the digester (10) is approximately the same as is the level of cooked pulp in vertical part of conveyor (3) that transfers the cooked pulp to the further processing in the disperger (11).

(iii) Disperging

The cooked pulp is further processed in the disperger (11), in order to separate mutually connected plant fibers from the pulp into fine suspension of separated fibers. Thus processed pulp is collected into auxiliary vessel (12). The suspension in this phase is of concentration range of 15-18% w/w of dry matter.

(iv) Dilution

The disperged pulp is discharged by a conveyor (4) into the dilution vessel (13), in which, the suspension is diluted with addition of fresh water via manifold (44) and regenerated water that comes from a manifold (32), to the concentration of 3-6% of dry matter (pulp). Such diluted pulp suspension is transferred by a line (33) into the auxiliary vessel (14).

(v) Screening and Fractionation

The suspension of pulp of 3-6% w/w concentration is pumped from the auxiliary vessel (14) by the line (34) to the screening and fractionating device (15) equipped with 0.1-0.5 mm sieve.

In this device, the pulp is screened and fractioned into two distinct fractions:

(a) the first fraction, that does not passed through the 0.1-0.5 mm screen, in amount of maximally 50% w/w, that is further transferred by line (36) and processed by milling in 1-3 mills (16), and then:
   returned back to the auxiliary vessel (14) by the line (36) in step (iv), for the reprocessing via steps (iv) and (v); or, optionally,
   transported by line (37), which is operated by the valve (51), directly into the auxiliary vessel (17) for further processing; and (b) the second fraction; that does passed through the 0.1-0.5 mm screen, in amount of minimally 50% w/w, which is considered as a good material for further processing; this material is transported by the line (35) directly into the auxiliary vessel (17), which serves for collection of processed, yet not concentrated pulp.

(vi) Concentration, Dilution, and Preparation of Pulp for Further Production

The suspension of pulp, of concentration of 3-6% w/w, is transferred from the auxiliary vessel (17) by line (38) to dewaterer (18). In this device, the excess of liquid phase is removed from the pulp yielding:

(a) concentrated pulp suspension of concentration of up to 30% w/w; and (b) regenerated water phase (black liquor) that contains also a traces of digesting chemicals, and, which is regenerated back to the process by manifold (32) to either digester (10) or dilution vessel (13).

After concentration in dewaterer (18), the cellulose pulp is transferred by line (39) into the auxiliary vessel (20).

Auxiliary vessel (20) serves for collection of concentrated, or optionally bleached, pulp of concentration of up to 30% w/w, and its dilution to the working concentration of 3-6% w/w, which is required for further paper manufacturing. In this manner, the auxiliary vessel (20) is equipped with addition manifold (43) for fresh water addition.

Finally, the pulp suspension is transferred from auxiliary vessel (20) by the line (41) to the connected vessel (21, 22), wherein the pulp suspension is diluted up to the concentration of 3-6% w/w, and prepared to reach acceptable hydrostatic pressure for further processing in the paper manufacturing machine. The role of connected vessel (21, 22) is to integrate the fluctuation of the pulp via maintaining its hydrostatic pressure constant in the manner know in the art.

Final cellulose pulp suitable for paper manufacturing is pumped/transported from the connected vessel (21, 22) by the line (42) to the further processing into unbleached (brown) paper.

In the case that final cellulose pulp is not used for paper manufacturing, then, the suspension that comes out from the auxiliary vessel (20) is processed by conventional pressing and drying to yield unbleached pure cellulose in the form of sheets (not shown in the FIG. 2).

(vii) Pulp Bleaching—Optional

In the case of manufacturing of bleached pulp for manufacturing of white papers or bleached cellulose sheets, the concentrated pulp suspension is transferred by line (39) to the bleaching vessel (19), wherein the pulp is bleached by any conventional process, e.g. by either hydrogen peroxide ($H_2O_2$)— or sodium hypochlorite (NaOCl)-based technologies. This is controlled by the valve (52); closed valve direct the concentrated cellulose pulp into the bleaching vessel (19). The bleaching process yields in bleached cellulose pulp that is further transferred from the bleaching vessel (19) by the line (40) and the part of line (39) into the auxiliary vessel (20); FIG. 2.

As described above for unbleached cellulose pulp, in this case, the bleached cellulose pulp is also diluted with fresh water in the auxiliary vessel (20) down to the concentration of 3-6% w/w, and prepared in connected vessel (22, 23) for further production of white paper.

Alternatively, the bleached cellulose pulp is processed by conventional pressing and drying into the bleached sheets of pure cellulose, that is not shown in the FIG. 2.

Grass-Like Feedstock

The grass-like feedstock that can be used in the production of cellulose pulp according to this invention includes stems of plant species selected from the group consisting of: wheat/*Triticum vulgare*, Linne/; rice/*Oryza sativa*, Linne/; barley/*Horedum vulgare*, Linne/; oat/*Avena sativa*, Linne/; flax/*Linum usitatissimum*, Linne/; maize/*Zea mays*, Linne/; millets: proso millet/*Panicum miliaceum*, Linne/, pearl millet/*Pennisetum glaucum*, Linne/, browntop millet/*Panicum ramosum*, Linne/, and barnyard/*Echinochloa frumentaceae*, Linne/; *triticale*×*Triticosecale*, Wittm. ex *A. Camus*/; buckwheat/*Fagopyrum esculentum*, Moench/; *miscanthus/Miscanthus*×*giganteus*, Andersson/; switchgrass/*Panicum virgatum*, Linne/; *sorghum/Sorghum* species, Linne/; common reed/*Phragmites australis*, Cav./, giant reed/*Arundo donax*, Linne/, burma reed/*Neyraudia reynaudiana*, Kunth./, reedmace/*Typha* spp., Linne/, paper reed/*Cyperus papyrus*, Linne/, bur-reed/*Sparganium* spp., Linne/, thatching reed/*Thamnochortus insignis*, Linne/; esparto grass/*Stipa tenacissima,* Linne and *Lygeum spartum*, Linne/; jute/*Corchorus olitorius*, Linne/; bamboo/*Bambusoideae* spp., Linne/; *bagasse*; or mixtures thereof.

The preferred grass-like feedstock is *miscanthus/Miscanthus*×*giganteus*, Andersson/.

The cellulose pulp from this invention is further manufactured into the paper. The latter is of significantly improved properties than is the paper manufactured from conventional wood-based feedstock obtained, for instance, from poplar/*Populus alba*, Linne/by the conventional technology, other than is the process from this invention.

Comparative results of key parameters of the paper manufactured from the cellulose pulp from this process obtained from 100% *miscanthus/Miscanthus*×*giganteus*, Andersson/feedstock, in comparison with conventional poplar-based paper, are given in Table 1.

TABLE 1

Comparative results of papers obtained from the cellulose pulp from the process of this invention (column 4) in comparison with conventional poplar-based paper manufactured by the conventional cellulose pulp (column 3).

| No. | Paper parameter | Conventional poplar-based paper (state-of-the art) | 100% miscanthus-based paper - (this invention) |
|---|---|---|---|
| 1 | Freeness (mlCSF) | 250 | 126 |
| 2 | WRV (%) | — | 217 |
| 3 | Breaking length (m) | 2.800 | 4.095 |
| 4 | Scott Bond (J/m$^2$) | — | 31 |
| 5 | Tear (mN m$^2$/g) | — | 3.6 |
| 6 | Bulk (cm$^3$/g) | 2.4 | 2.2 |
| 7 | Shives (S-ville 0.15 mm; %) | 0.1 | 0.5 |

The results from the development phase show that, in comparison with conventional wood-based processes, the technology from the present invention does result in 44% less (thermal) energy consumption at the same material output of cellulose pulp.

INDUSTRIAL APPLICATION

This invention is used as the manufacturing technology for production of cellulose pulp for paper making. Thus, industrial applicability of this invention is obvious.

LIST OF REFERENCES

1—conveyor
2—conveyor
3—conveyor
4—conveyor
10—digester
11—disperger
12—auxiliary vessel
13—dilution vessel
14—auxiliary vessel
15—screening and fractionation device
16—pulp mill
17—auxiliary vessel
18—dewaterer
19—bleaching vessel
20—auxiliary vessel
21,22—connected vessel
30—fresh water manifold
31—steam manifold
32—regenerated water manifold
33—line
34—line
35—line
36—line
37—line
38—line
39—line
40—line
41—line
42—line
43—fresh water manifold
44—fresh water manifold
51—valve
52—valve
M—driving electromotor

The invention claimed is:

1. A continuous process for production of cellulose pulp from grass-like plant feedstock, comprising the steps of:

(i) preparing the grass-like plant feedstock by comminuting to produce a feedstock with longitudinal size distributed from 1.5-30 cm and diameter of 0.5-15 mm, and with removed fine dusty particles by dedusting of said feedstock with fan;

(ii) continuous digestion of a grass-like dust-free plant feedstock prepared in step (i) in a digester formed as a vertical column internally having only smooth side walls; where dust-free grass-like plant feedstock is continuously fed directly on the top of the said digester via conveyor;

wherein, in parallel with said dust-free feedstock top-feeding, the chemicals for digestion selected from the group consisting of NaOH and NaCl or $Na_2SO_3$, fresh water, regenerated water, and steam are introduced continuously on the top of said digester; maintaining the digestion temperature from 70-100° C. and average composition of thus formed suspension during said continuous digestion within the following ranges:

(a) 0.9-1.5% w/w of NaOH;

(b) 0.15-0.4% w/w of NaCl or $Na_2SO_3$; and (c) 15-18% w/w of grass-like plant feedstock;

where concentrations of ingredients being calculated on the weight of the liquid phase;

where dissolution of noncellulosic substances from the grass-like plant feedstock is performed during the mass transfer from the top to the bottom of the said digester performed only by the gravity that lasts 40 minutes to 2 hours, and where cooked pulp is concentrated at the bottom of the digester, and continuously, by equal rate as being feedstock fed into the digester, discharged from the bottom of the said digester by the conveyor having the hydraulic pressure compensation, wherein the grass-like feedstock includes stems of plant species selected from at least one of: wheat/*Triticum vulgare*, Linne/; rice/*Oryza sativa*, Linne/; barley/*Horedum vulgare*, Linne/; oat/*Avena sativa*, Linne/; flax/*Linum usitatissimum*, Linne/; maize/*Zea mays*, Linne/; millets: proso millet/*Panicum miliaceum*, Linne/, pearl millet/*Pennisetum glaucum*, Linne/, browntop millet/*Panicum ramosum*, Linne/, and barnyard/*Echinochloa frumentaceae*, Linne/; triticale/×*Triticosecale*, Wittm. ex *A. Camus*/; buckwheat/*Fagopyrum esculentum*, Moench/; *miscanthus/Miscanthus×giganteus*, Andersson/; switchgrass/*Panicum virgatum*, Linne/; *sorghum/Sorghum* species, Linne/; common reed/*Phragmites australis*, Cav./, giant reed/*Arundo donax*, Linne/, burma reed/*Neyraudia reynaudiana*, Kunth./, reedmace/*Typha* spp., Linne/, paper reed/*Cyperus papyrus*, Linne/, bur-reed/*Sparganium* spp., Linne/, thatching reed/*Thamnochortus insignis*, Linne/; esparto grass/*Stipa tenacissima*, Linne and *Lygeum spartum*, Linne/; jute/*Corchorus olitorius*, Linne/, bamboo/*Bambusoideae* spp., Linne/, *bagasse*, or mixtures thereof.

2. A continuous process for production of cellulose pulp according to the claim 1, further comprising the steps of:

(iii) disperging, where a suspension of the cooked pulp discharged from the step (ii) is processed through a disperger;

(iv) diluting, where pulp being disperged in step (iii) is diluted with water in a dilution vessel from a starting concentration 15-18% w/w to a concentration of 3-6% w/w of pulp; and (v) screening and fractionation, where diluted suspension from the step (iv) is processed through a screening and fractionation device equipped with 0.1-0.5 mm sieve, yielding two fractions;

the first fraction that does not passed through the 0.1-0.5 mm screen, in amount of maximally 50% w/w; and the second fraction that does passed through the 0.1-0.5 mm screen, in amount of minimally 50% w/w, which is considered as a good material for further processing that is transferred into an auxiliary vessel.

3. A continuous process for production of cellulose pulp according to the claim 2, wherein the first fraction obtained in step (v) is further processed by milling in 1-3 mills, and then:

(a) returned back to the auxiliary vessel in step (iv) for the reprocessing via steps (iv) and (v); or (b) transferred directly into the auxiliary vessel.

4. A continuous process for production of cellulose pulp according to the claim 2, wherein the material collected in the auxiliary vessel is further processed in the process comprising the steps of:

(vi) concentration in a dewaterer to remove black liquor, dilution in the auxiliary vessel with fresh water, and preparation of cellulose pulp in connected vessel; and (vii) optionally, a pulp bleaching step in a bleaching vessel regulated via valve, yielding cellulose pulp suitable for paper manufacturing or production of cellulose sheets; where the used water regenerated in the dewaterer is returned through manifold back to the digester in step (ii) and into the dilution vessel in step (iv).

5. A continuous process for production of cellulose pulp according to claim 1, wherein the chemicals for digestion in step (ii) are introduced as a mixture of chemicals or each chemical separately in the form of crystalline solids or pellets.

6. A continuous process for production of cellulose pulp according to claim 1, wherein the chemicals for digestion in step (ii) are introduced as a mixture of chemicals or each chemical separately in the form of concentrated aqueous solutions of 30-50% w/w NaOH; and 20-30% w/w of NaCl or $Na_2SO_3$.

7. A continuous process for production of cellulose pulp according to claim 1, wherein the digestion temperature is 94-98° C.

8. A continuous process for production of cellulose pulp according to the claim 1, wherein the grass-like feedstock is *miscanthus/Miscanthus×giganteus*, Andersson/.

9. A continuous process for production of cellulose pulp according to the claim 3, wherein the material collected in the auxiliary vessel is further processed in the process comprising the steps of:

(vi) concentration in a dewaterer to remove black liquor, dilution in the auxiliary vessel with fresh water, and preparation of cellulose pulp in connected vessel; and (vii) optionally, a pulp bleaching step in a bleaching vessel regulated via valve, yielding cellulose pulp suitable for paper manufacturing or production of cellulose sheets; where the used water regenerated in the dewaterer is returned through manifold back to the digester in step (ii) and into the dilution vessel in step (iv).

* * * * *